US006170287B1

(12) United States Patent
Leitch et al.

(10) Patent No.: US 6,170,287 B1
(45) Date of Patent: Jan. 9, 2001

(54) DESICCANT INSTALLATION FOR REFRIGERANT CONDENSER WITH INTEGRAL RECEIVER

(75) Inventors: Frank Joseph Leitch, North Tonawanda; Michael Czajkowski, Lockport; Robert Charles Gmerek, Burt; Steve C. Brick, Lockport, all of NY (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/384,091

(22) Filed: Aug. 27, 1999

(51) Int. Cl.[7] ..... F25B 43/00; F25B 39/04
(52) U.S. Cl. ..... 62/474; 62/509
(58) Field of Search ..... 62/474, 509

(56) References Cited

U.S. PATENT DOCUMENTS

| | | | | |
|---|---|---|---|---|
| 4,354,362 | | 10/1982 | Schumacher et al. | 62/474 |
| 5,146,767 | * | 9/1992 | Kadle et al. | 62/509 |
| 5,159,821 | | 11/1992 | Nakamura | 62/509 |
| 5,177,982 | | 1/1993 | Plemens | 62/503 |
| 5,537,839 | | 7/1996 | Buck et al. | 62/474 |
| 5,666,791 | * | 9/1997 | Burk | 62/474 |
| 5,813,249 | | 9/1998 | Matsuo et al. | 62/509 |
| 6,038,884 | * | 3/2000 | Dabrowski | 62/509 |

* cited by examiner

*Primary Examiner*—William E. Tapolcai
*Assistant Examiner*—Mohammad M Ali
(74) *Attorney, Agent, or Firm*—Patrick M. Griffin

(57) ABSTRACT

A condenser (10) with a return header tank (14) has a receiver or reservoir canister (22) physically attached along side the return header tank (14), and open thereto through a discrete upper inlet (20) and lower outlet (21). The bottom of canister (22) is closed by an end cap (34) that is, preferably, welded or brazed in place. Before end cap (34) is attached, a tube of desiccant material (24) is installed and located within canister (22) by a standoff (26) comprised of a tight fitting, notched, disk shaped base (28) and narrow central post (30) which is comparable in length to the height of the inlet (20) above the lower end cap (34). The tight fit allows the tube (24) to be inserted up into the canister (22), well away from the bottom of canister (22) and free of heat damage as the end cap (34) is attached. Later, in operation, the central post (30) keeps the tube (24) located clear of the inlet (20) and outlet (21).

1 Claim, 3 Drawing Sheets

DESICCANT INSTALLATION FOR REFRIGERANT CONDENSER WITH INTEGRAL RECEIVER

TECHNICAL FIELD

This invention relates to air conditioning systems in general, and specifically to an improved desiccant installation for a condenser having an attached receiver.

BACKGROUND OF THE INVENTION

Automotive air conditioning systems typically include either an accumulator canister or a receiver canister that serve as a refrigerant reservoir. An accumulator is located just before the compressor, and allow only (or substantially only) refrigerant vapor to be drawn off of the top before compression, with liquid settling at the bottom. Receiver canisters are located just after the condenser, and are intend to allow only (or substantially) only liquid refrigerant to be drawn off the bottom for the refrigerant expansion valve. A canister of either type also provides a convenient location for a container of desiccant material, usually a bag or pouch of mesh material, which absorbs water vapor from the liquid refrigerant reservoir. Either an accumulator or a receiver usually has ample room within it for the desiccant, and some kind of pre existing piping arrangement within it from which the desiccant bag can be conveniently suspended. The desiccant works better if suspended within, rather than resting free on the bottom of, the canister, and is also less subject to damage in the event that a bottom closure is later welded to the canister. A typical example of such an arrangement may be seen in U.S. Pat. No. 4,354,362, where an internal pipe provides a practical suspension post for a desiccant container.

A relatively recent trend is the attached or so called "integral" receiver, in which a reservoir canister is incorporated structurally onto, on into, the return header tank of a so called cross flow condenser design. A cross flow or "headered" condenser typically has a main pass, within which gas condenses to liquid, and a sub cooling section, within which liquid refrigerant is further cooled. An example may be seen in U.S. Pat. No. 5,537,839. The reservoir runs along the side of the return tank, and two openings or short pipes near the base of the return tank connect the main pass condenser tubes to the reservoir canister. The two openings are separate or discrete, so that all condensed refrigerant entering the return tank from the main pass is forced to flow through the upper opening and into the reservoir canister, where it forms a rising or falling reserve liquid column (depending on conditions). From the reservoir canister, liquid refrigerant can flow into the discrete lower opening and into the sub cooling section, and ultimately to the expansion valve. Generally, and preferably, the reservoir canister or tank section is no more than an empty vessel, with no internal structure suitable for suspending a desiccant cylinder or pouch. One exception may be seen in U.S. Pat. No. 5,159,821. There, refrigerant is forced centrally up into the reservoir canister in a fountain like central pipe, which also provides a convenient suspension pole for the desiccant cylinder. This is an undesirably complex and expensive structure, however.

More typically, the desiccant would simply rest where gravity would take it anyway, on the inside of the base of the reservoir canister, and this is the situation disclosed in U.S. Pat. No. 5,537,839, already noted above. This puts the desiccant container both in a position where it could be damaged by welding or brazing on a bottom closure, and in a position where it is axially coextensive with, and could clog or block, the discrete openings between the reservoir canister and the return manifold. The patent recognizes this issue by providing a separate bottom threaded plug for installing the desiccant container. There is also provided an additional internal cage like structure to confine the desiccant away from the openings. That same structure retains the desiccant so that it is in line with the openings, and therefore at least theoretically capable of blocking them. Furthermore, the cage like structure represents a potential threat to the structural integrity of the desiccant container, which is generally a cloth or plastic open mesh, especially when subjected to vibration and bouncing in operation. Both the threaded plug and the retention cage also require additional cost and manufacturing steps.

SUMMARY OF THE INVENTION

An improved desiccant installation for a condenser with an integral receiver is provided in accordance with claim 1.

In the embodiment disclosed, a refrigerant condenser of the cross flow, headered type has an inlet header on one side, a return header on the other, and an upper or main pass section of flow tubes divided from a smaller sub cooler section by a separator located near the bottom of the return tank. Alongside the return tank, a simple cylindrical reservoir canister is structurally attached by any suitably solid and compact means. The main pass empties into the return header, which then empties into the reservoir canister through a discrete inlet just above the separator. From the reservoir canister, the liquid refrigerant empties back into the return tank through an outlet and then into the sub cooler section. There is no inner structure within the reservoir canister beyond the smooth inner wall, and it is preferably enclosed at top and bottom by a simple cap that is brazed or welded in place, giving a simple and reliable seal.

A cylindrical, open mesh container of desiccant material has a diameter that gives it a small radial clearance from the inner wall of the reservoir canister, and an axial length which, if it were allowed to rest on the bottom of the reservoir canister, would put it in line with both the inlet and outlet, and liable to block free flow through them. However, this is prevented by a standoff structure that consists of a narrow, centrally located bottom post and an upper, disk shaped base. The post is longer than the height of the inlet above the bottom end cap of the reservoir canister, and the base has an outer diameter that makes a tight interference fit with the inner wall of the reservoir canister. Therefor, the standoff structure can be used to insert the desiccant into the reservoir canister before the bottom end cap is sealed in place. The desiccant can be inserted past and beyond the inlet and outlet openings, where it will remain, at least temporarily, until after the bottom cap is welded in place, safe from heat damage. In later operation, the interference fit will help prevent vibration and damage of the desiccant tube within the canister, and even if the desiccant should sink downwards, the desiccant itself will never rest on the bottom of the canister, or block the inlet and outlet, because of the dimensions of the post. Cut outs are provided in the edge of the disk to allow liquid refrigerant to freely flow up or down past the disk.

BRIEF DESCRIPTION OF THE DRAWINGS

These and other features of the invention will appear from the following written description, and from the drawings, in which.

DESCRIPTION OF THE PREFERRED EMBODIMENT

Figure 1:
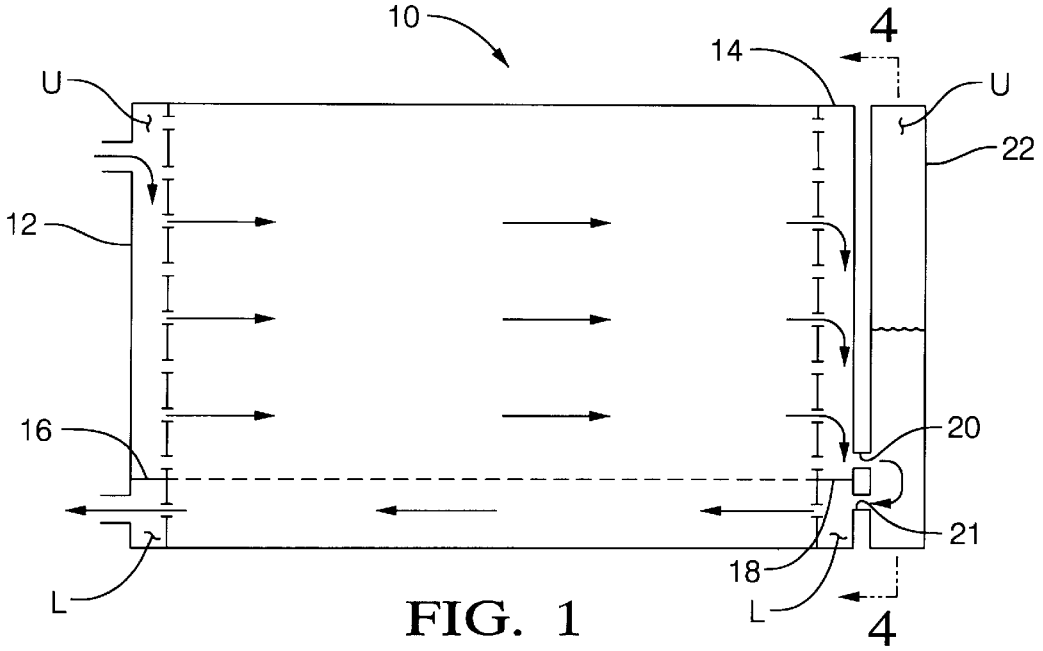
FIG. 1 is a schematic view of the type of condenser in which the invention is installed.

Referring first to FIG. 1, a condenser 10 of the cross flow, headered type has an inlet/outlet header tank 12 on one side, and a return header tank 14 on the other, each of which is divided into discrete upper (U) and lower (L) sections by separators 16 and 18 respectively. Heated, compressed refrigerant vapor enters the upper section (U) of header tank 12, above separator 16, and flows across and through the flow tubes in the main pass section (not illustrated in detail). In the main pass, refrigerant is condensed to liquid form and flows into the upper section (U) of return tank 14, above the separator 18. From there, all liquid refrigerant is forced, by the separator 18, to flow through an upper inlet 20 and into an attached reservoir canister 22, where it backs up into a reserve column of varying height. From the reserve column, liquid refrigerant can flow down and through a lower outlet 21, into lower section (L) of return tank (14) and ultimately into a sub cooler section of condenser 10, comprised of those flow tubes located below the two separators 16 and 18. In the sub cooler section, liquid refrigerant is further cooled, below the temperature necessary to simply condense it, and flows finally back into the lower section (L) of header tank 12. No desiccant structure is illustrated within canister 22 in FIG. 1, but that is described next.

Figure 2:
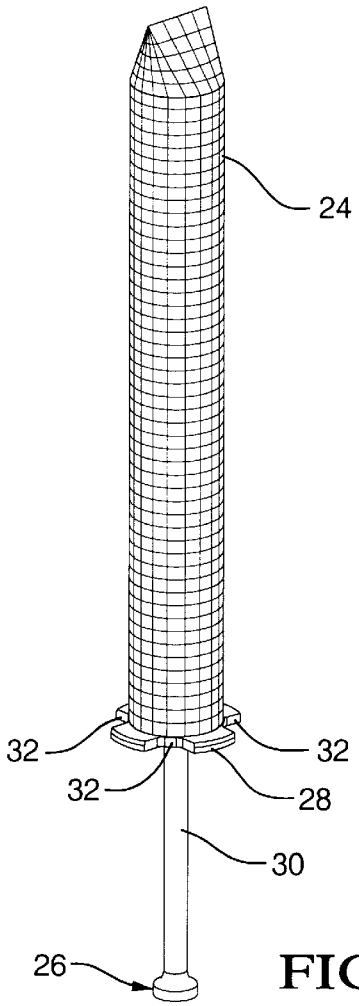
FIG. 2 is a perspective view of a desiccant tube and standoff.
Figure 3:
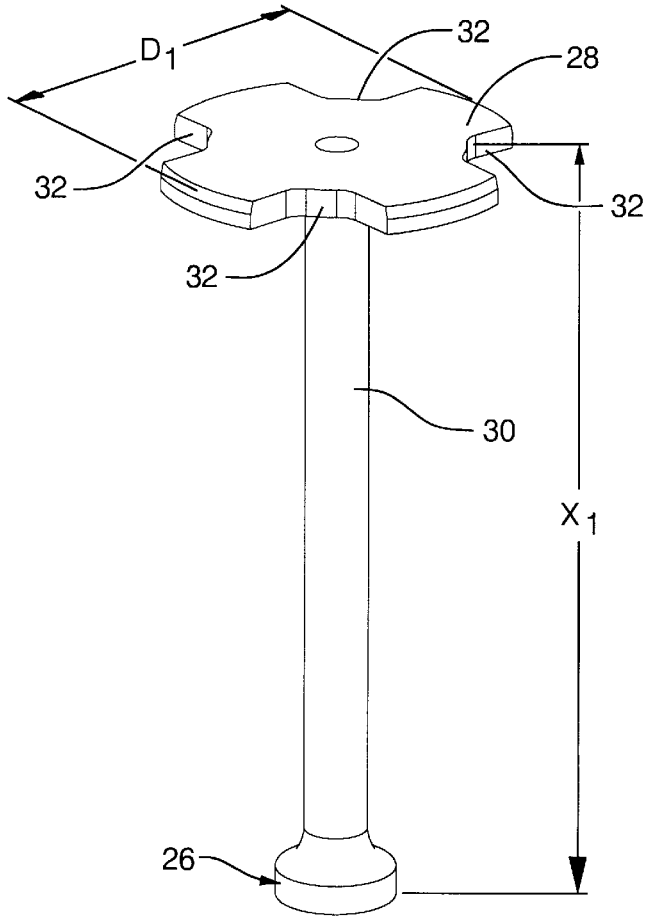
FIG. 3 is a perspective view of just the standoff structure.

Referring next to FIG. 2, a desiccant container comprises a simple, elongated cylindrical tube 24 of mesh material, which has an open weave with a fill of conventional granular desiccant material contained within. Tube 24 is heat sealed or otherwise closed at the top, and, at the bottom, is preferably fixed to a standoff, indicated generally at 26. Standoff 26 is an integral structure, which may be formed of any suitable heat and refrigerant resistant material. A disk shaped base 28 at the top is supported on a narrow, solid central post 30 of axial length X1. Base 28 is four lobed, with a circular outer edge of diameter of D1, broken into four equal arcs by four cut outs 32. In the embodiment disclosed, tube 24 is preferably fixed centrally to the upper surface of base 28 by glue, sonic welding or other technique to create a unit that can be handled during installation as, and operate later as, a single component.

Figure 4:
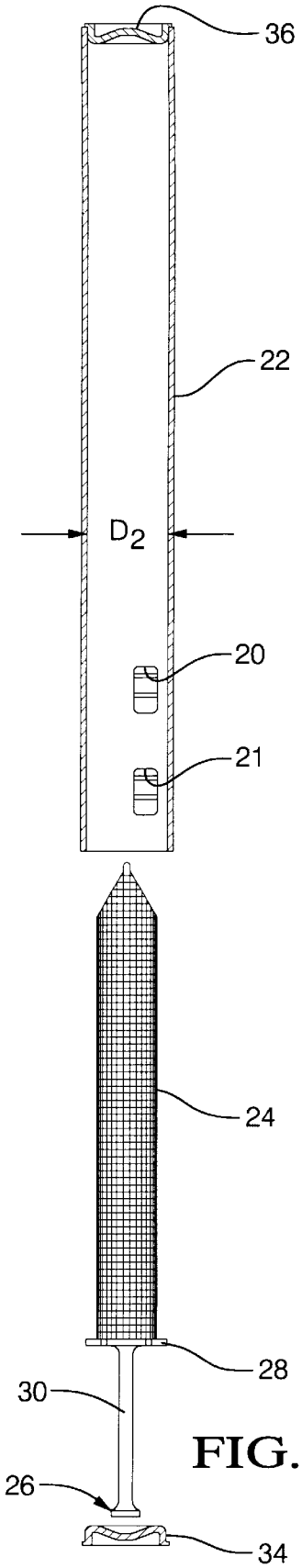
FIG. 4 a view showing a cross section of the reservoir canister with the desiccant tube-standoff unit aligned therewith.
Figure 5:
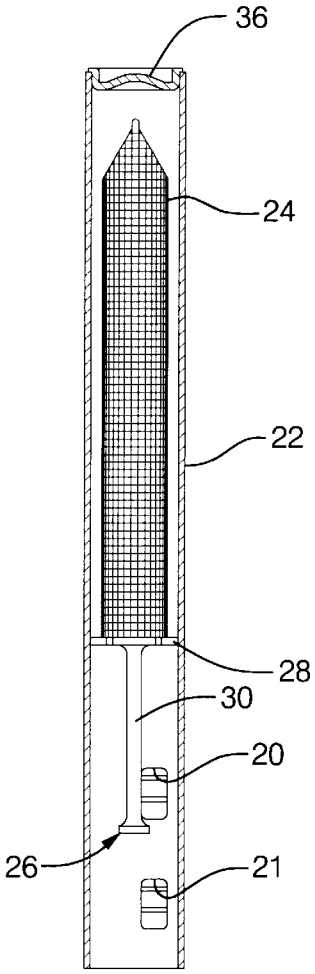
FIG. 5 is a view like FIG. 4 showing the unit over inserted prior to canister closure.

Referring next to FIGS. 4 and 5, reservoir canister 22 is shown prior to having its open lower end closed by an end cap 34. The upper end has already been closed by an upper end cap 36. As disclosed, at this point in the manufacture, the entire condenser 10 would have been run through the braze oven, and be complete, but for the installation of the desiccant containing tube 24 and the lower end cap 34. However, it could be that neither end cap 34 or 36 is in place, or, the lower end cap 34 could be in place, but not the upper end cap 36. The invention will accommodate any of those possible scenarios. Next, as shown in FIG. 5, the tube 24 is inserted into the inside of canister 22, through the open lower end, by pushing up on the standoff 26. This could be done easily by hand, or automated, since the post 30 and base 28 are easily grabbed and manipulated, and are not subject to damage, as the material of the tube 24 would be. The tube 24-standoff 26 unit is pushed in until the arcuate edges of base 28 tightly engage the inner wall of canister 22 with an interference fit. The inner wall of canister 22 has a diameter D2 that is sufficiently smaller than diameter D2 to assure that snug fit. The unit is pushed to the point shown in FIG. 5, where the end of the tube 24 is clear of the upper end cap 36, and the bottom of post 30 is clear of the bottom of canister 22. It will remain in that position, at least temporarily, by virtue of the interference fit.

Figure 6:
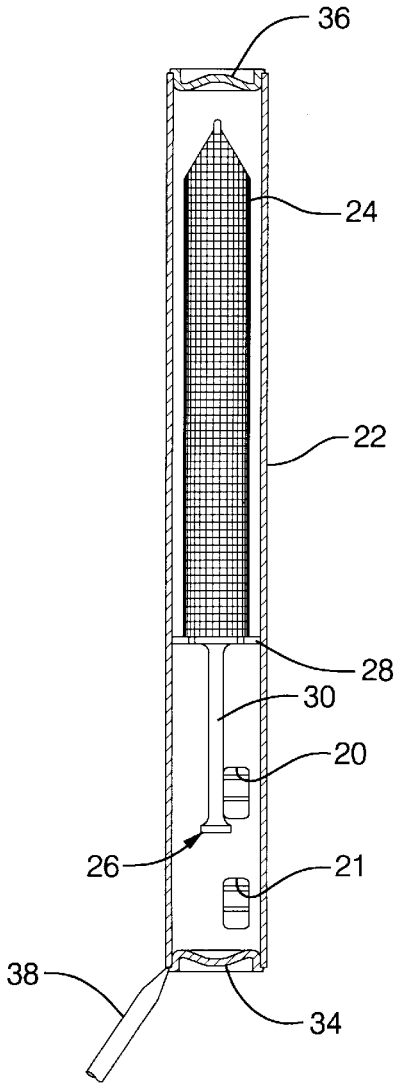
FIG. 6 is a view like FIG. 5, showing the canister closure welding, process with the desiccant container held in a protected position.
Figure 7:
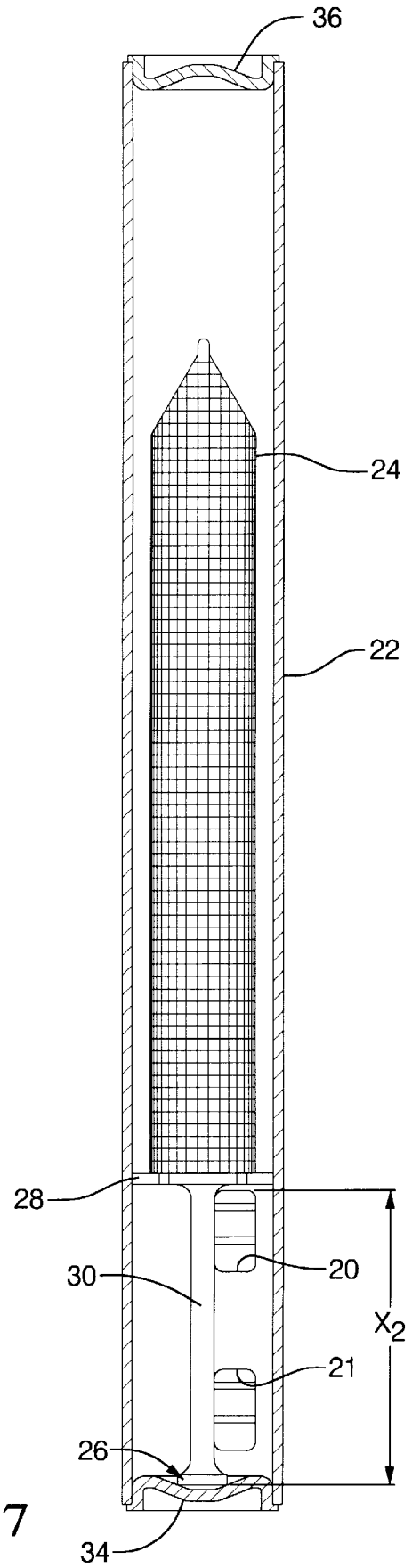
FIG. 7 shows the location of the unit within the reservoir canister after an equilibrium position has been reached during operation.

Referring next to FIGS. 6 and 7, Once the tube 24-standoff 26 unit has been pushed into canister 22, the bottom end cap 34 is welded into place by welding tool 38. In the location shown, the tube 24, and even the bottom of post 30, are well clear of the heat produced by the bottom closure process. The cap 34 provides a very inexpensive and secure closure and seal, as compared to a threaded plug, or other closure that is installed without heat. Later, in operation, the tube 24-standoff 26 unit can sink down under the force of gravity and vibration, as shown in FIG. 7, until the bottom of post 30 rests on the bottom end cap 34. However, the height of the upper inlet 20 above the bottom end cap 34, indicated at X2, is comparable to or less than the length X1 of the post 30. Post 30, then, is sufficient to keep the tube 24, supported on base 28, above and clear of the inlet and outlet 20 and 21 at all times during operation, so that flow in or out will not be impeded. Once flow has entered the canister 22 below the base 28, it can flow freely up (or back down) through the cut outs 32, and around (and through) the mesh material of the tube 24. In addition, the surface of the tube 24 is kept away from the sharp edges of the openings 20 and 21, where it could be damaged, and is exposed only to the smooth, upper inner surface of canister 22, where it is far less subject to damage. Furthermore, fixing the bottom of tube 24 to the base 28 helps to keep the tube 24, which has some inherent stiffness, radially centered and away from the wall of canister 22, preserving a radial clearance for refrigerant flow. So doing also prevents tube 24 from bouncing axially up and down within canister 22 in operation.

Variations in the disclosed embodiment could be made. The base 28 need not be directly attached to the bottom of tube 24, nor the post 30 directly attached to base 28, and the two would still act as a locater and standoff. The standoff function alone could be provided, most simply, just by a post 30 of sufficient length (long enough to keep the tube 24 off of the bottom of the canister 22). A disk shaped structure like base 28 would be needed to allow the bottom of tube 24 to rest on post 30 without damage, while still being open to refrigerant flow past the base 28. That disk like structure could be integral to, or even a part of the bottom of, tube 24, however, and could be open to refrigerant flow by virtue of being a meshed structure or the like, instead of having the cut outs 32. Having a discrete structure, like base 28, anchored to the bottom of tube 24, rather than just resting freely on top of it, provides the additional advantages noted above of keeping the tube 24 axially and radially located, in addition to just keeping it off of and away from the bottom cap 34 and clear of the ports 20 and 21.

What is claimed is:

1. A condenser (10) having a generally vertically oriented return header tank (14) on one side with a separator (18)

dividing it into an upper section (U) and a lower section (L), and a generally cylindrical reservoir canister (22) attached beside return header tank (14) having an inlet (20) into the return header tank upper section (U) and an outlet (21) into the return tank lower section (L), said canister (22) also having a lower end closure (34), characterised in that, said canister (22) includes a desiccant material container (24) located therewithin by a standoff (26) having a generally circular, disk shaped base (28) with edge cutouts (32), said base (28) making an interference fit with the inside of canister (22) and being fixed to the lower end of material container (24), said standoff also having a central post (30) that is fixed to base (28), and which is substantially narrower than the inside of canister (22), and substantially as long as the axial height of inlet (20) above the lower end closure (34), whereby base (28) serves to locate desiccant material container (24) away from lower end closure (34) during installation, and, during operation, post (30) and base (28) serve to maintain the desiccant material container (24) away from the inlet (20) and outlet (21), while leaving the inlet (20) and outlet (21) unblocked, by virtue of the length and width of post (30).

* * * * *